United States Patent [19]

Ballard et al.

[11] Patent Number: 4,502,514

[45] Date of Patent: Mar. 5, 1985

[54] TONER CARTRIDGE AND METHOD OF REPLENISHING TONER TO A XEROGRAPHIC DEVICE

[75] Inventors: Philip D. Ballard; Cheryl A. Goin; Paul J. Josephson; Andrew D. Keller; Larry W. Lykins, all of Longmont; Jeffrey J. Miller, Boulder, all of Colo.

[73] Assignee: International Business Machines Corporation, Armonk, N.Y.

[21] Appl. No.: 514,996

[22] Filed: Jul. 18, 1983

[51] Int. Cl.[3] ..... B65B 1/04

[52] U.S. Cl. ..... 141/1; 141/98; 141/364; 53/449; 206/624

[58] Field of Search ..... 53/449, 382, 381 A, 53/492; 206/624, 628; 141/364, 1-12, 325-327, 98, 114, 313-317

[56] References Cited

U.S. PATENT DOCUMENTS

| | | | |
|---|---|---|---|
| 3,326,364 | 6/1967 | Waldrop et al. | 206/628 |
| 3,999,654 | 12/1976 | Pollack | 206/216 |
| 4,062,385 | 12/1977 | Katusha et al. | 141/89 |

*Primary Examiner*—Houston S. Bell, Jr.
*Attorney, Agent, or Firm*—Francis A. Sirr

[57] ABSTRACT

A bottom-dumping xerographic toner cartridge is protected by a storage and shipping package having strategically located zipper perforations, and a tuck-flap. One end of the package is removable by virtue of certain zipper perforations. Removal of this end, and operation of other zipper perforations, results in the tuck-flap being exposed for use in mounting the package on the reproduction device whose toner supply is to be replenished. The toner cartridge is then moved out of the package, into the reproduction device. The now-empty package remains supported in a position to catch the toner cartridge's traveling-fold seal, and any toner which may be transported out of the cartridge on the face of the seal.

10 Claims, 6 Drawing Figures

TONER CARTRIDGE AND METHOD OF REPLENISHING TONER TO A XEROGRAPHIC DEVICE

DESCRIPTION

1. Field of the Invention

The present invention relates to the field of electrophotographic reproduction, and to constructions and arrangements for replenishing xerographic toner to the developer station of such reproduction devices.

2. Related Application

The toner cartridge disclosed in this application is of the construction and arrangement disclosed and claimed in commonly assigned and copending U.S. patent application Ser. No. 514,997, filed July 18, 1983, incorporated herein by reference. While this toner cartridge is of exemplary utility in the present invention, the present invention is not to be limited by this specific construction and arrangement.

BACKGROUND OF THE INVENTION

The problem of replenishing toner to a xerographic developer station, in a convenient, clean and safe manner, while at the same time providing physical protection to the toner cartridge during storage, shipment, etc., has been worked on for many years by those skilled in this art.

A particularly good way to seal the cartridge and, at the same time, provide convenient and somewhat clean dumping of the toner to the developer station, involves the use of a traveling-fold seal which is glued to the bottom-disposed dump-opening of a box-like cartridge. The aforesaid copending application describes a cartridge of this type. Other examples are U.S. Pat. Nos. 3,999,654 and 4,062,385.

Prior to the present invention, all such cartridges were placed in a conventional, strong, corrugated paperboard box. This box was opened at the site of the device whose toner is to be replenished, the toner cartridge was removed, the now-empty box was set aside, and the cartridge was mounted on the reproduction device. The traveling-fold seal was then removed.

The features and advantages of the invention will be apparent from the following more particular description of preferred embodiments of the invention, as illustrated in the accompanying drawing.

Figure 1:
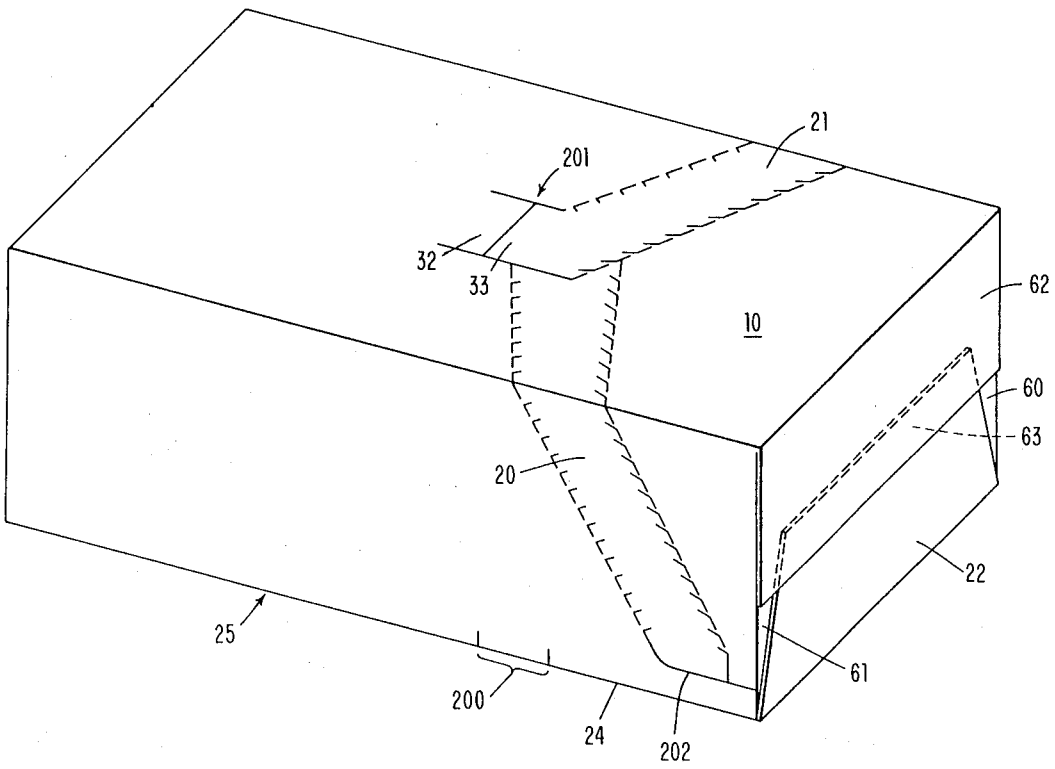
FIG. 1 shows the toner cartridge's protective outer package, as viewed from the top, and from the end (10) which is removable by operation of two zipper-perforated removable tabs (20, 21)
Figure 4:
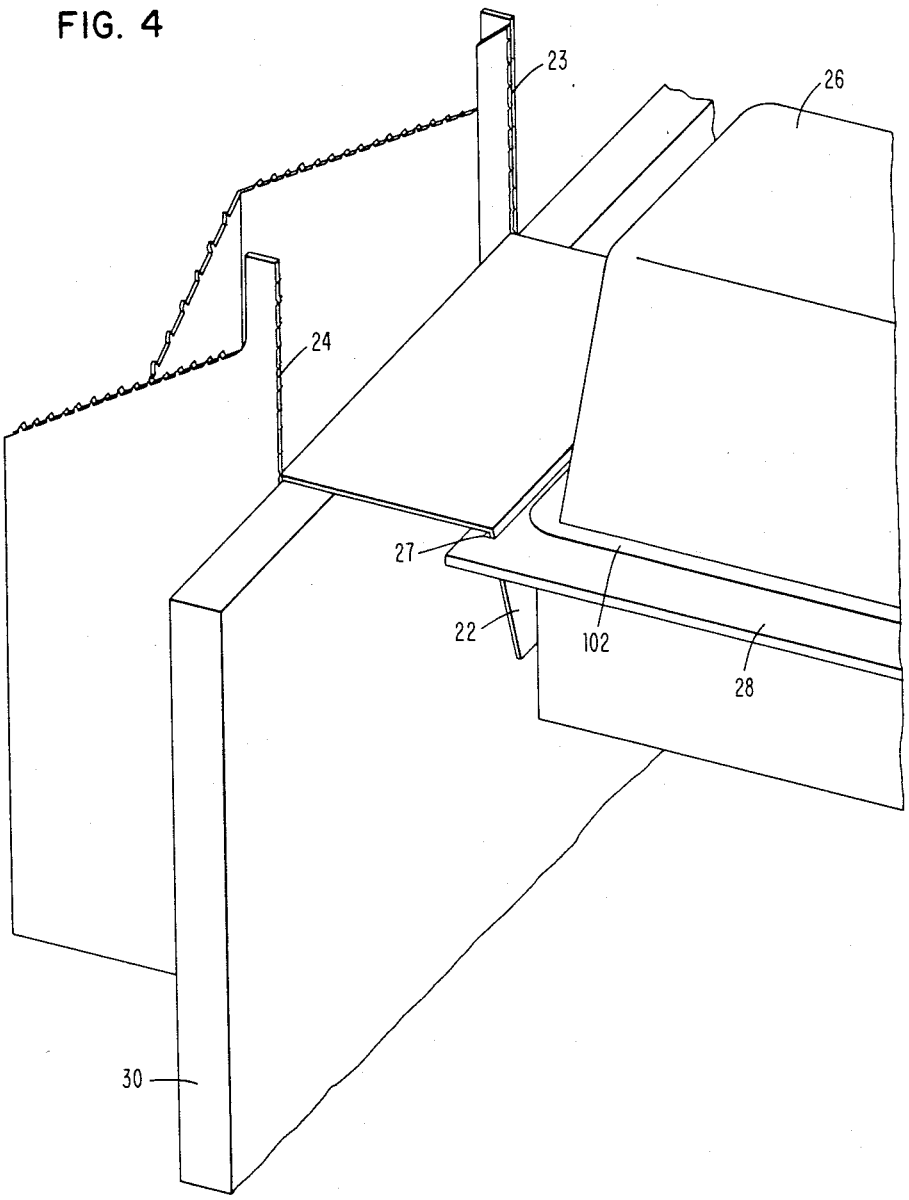
Figure 5:
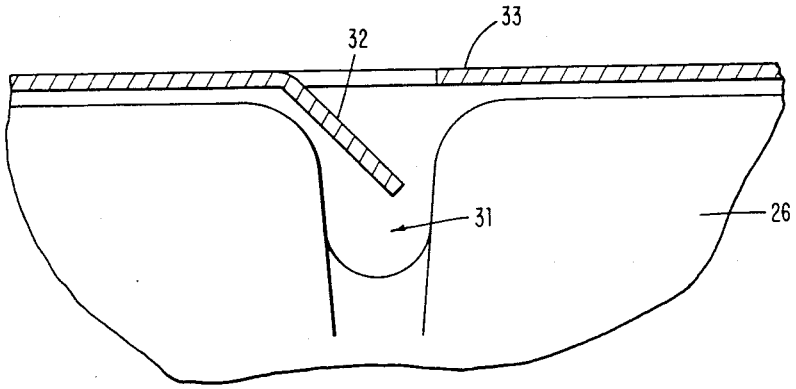
Figure 6:
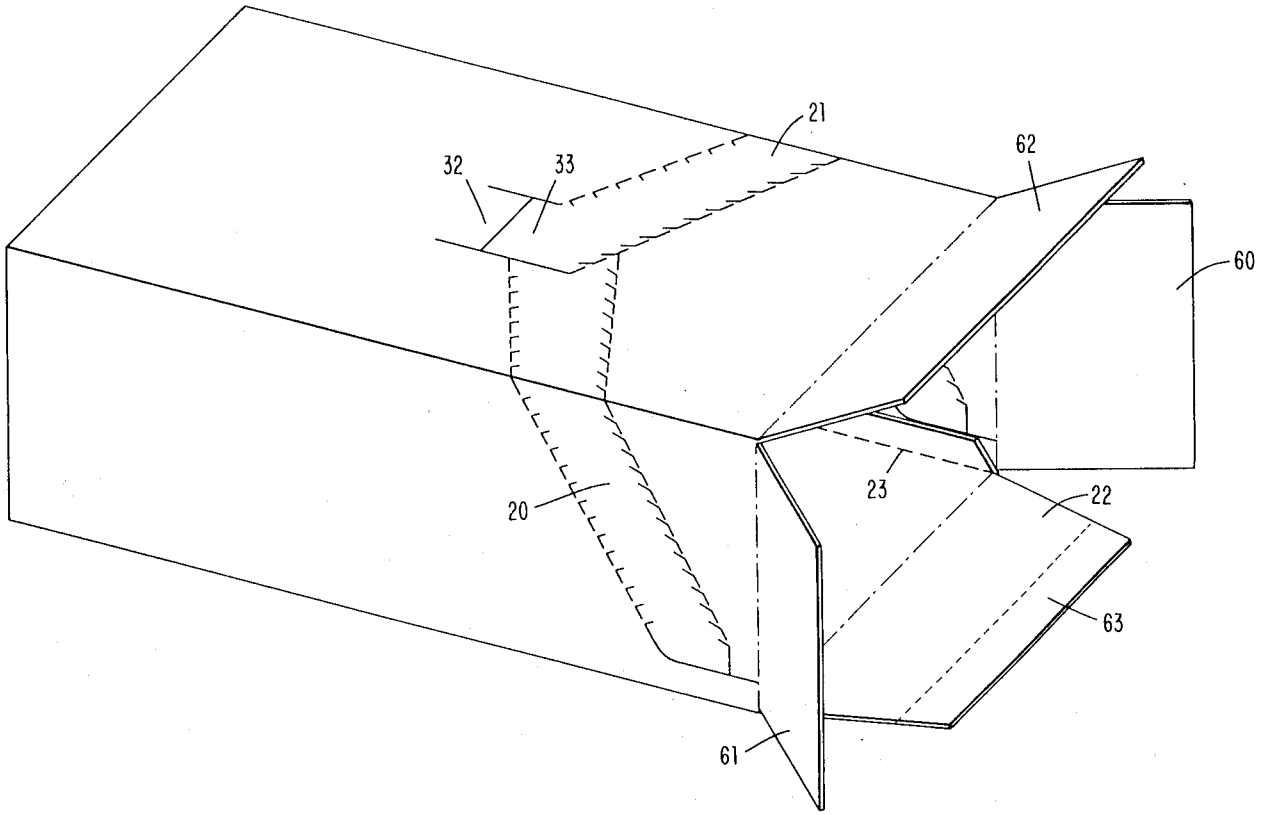

In this position, the cartridge (26) is aligned with the top of the replenisher unit, and as the package is supported by hand, while an exterior cabinet portion (30) of the reproduction device may help support and position the package;

FIG. 4 shows the toner cartridge in position on the reproduction device's toner replenisher. The tuck-flap's two zipper perforations (23, 24) have been severed so that the package's now-empty cavity faces upward, ready to receive the cartridge's traveling-fold seal, and any toner which may be brought out of the cartridge on the face of the seal;

FIG. 5 shows a recess (31) formed in the top of the toner cartridge, which recess enables a top portion (32) of the package to be manually pushed inward, to provide finger-access to the end (33) of one (21) of the zipper-perforated removable tabs; and FIG. 6 is a view like FIG. 1, showing the empty outer package, and particularly how the package is closed by first folding the side flaps (60 and 61), then folding the tuck-flap (22) without gluing, and lastly folding and gluing the top flap (62) to only the side flaps.

THE INVENTION

Practice of the present invention involves use of a double-function storage and shipment box or package in which a toner cartridge is contained or housed as the toner awaits use in an electrophotographic device such as a copier or a printer. More specifically, this double use involves use of the box to facilitate clean-loading of the toner cartridge unto or into the reproduction device; i.e., the box functions to catch toner which may escape from the device as the cartridge is opened to dump its toner content into the developer unit or station of the reproduction device.

In the following description, the IBM 3800 laser printer is used as an example. However, all that is necessary in order to practice the present invention is that the reproduction device's developer station be provided with a slot 27 (or an equivalent flap-receiver) which will receive tuck-flap 22 of the present invention. In addition, it is desirable (but not essential) that the reproduction device include a means to aid in supporting and positioning the opened box of the present invention, much as the 3800's outer cover 30 which is shown in FIG. 4.

The toner-cartridge-containing box aforesaid is of a general parallelepiped shape, as seen in FIG's. 1, 2 and 6. It is preferably formed of corrugated paper board of 275 pounds bursting strength, B flute, single-wall construction. Cartridge 26, which is contained within the box, holds about eight pounds of xerographic toner. The details of construction of this cartridge are contained in the aforesaid copending application. These details are not critical to the present invention.

The box is of conventional construction, with the exception of the end of the box which is best seen in FIG's. 1 and 6. This end of the box includes a removable end portion 10 which includes end flaps 60, 61 and 62. End 10 is removed merely by removing tabs 20 and 21. As seen in FIG. 1, tabs 20 and 21 terminate at through-cuts 202. Removal of these tabs is facilitated by the fact that these tabs are connected to the box only by virtue of zipper perforations, shown in dotted lines in the figures. An alternative construction of tabs 20 and 21 is later described.

As is best seen in FIG. 5, the top of the box includes a through-cut area 201 (FIG. 1) and a tab 32 which can be manually pushed inward, as shown, to allow finger access to the underside of portion 33 of zipper tab 21 (FIG. 1). Once tab 21 has been removed, tab 20 is available for convenient removal. Ideally, the toner cartridge is provided with a recess 31 which accommodates inward movement of tab 32.

The fact that box end 10 can now be removed is apparent from a consideration of FIG's. 1 and 6. After cartridge 26 is inserted in the box, at the location of toner manufacture, the box is sealed by first folding side flaps 60 and 61 inward from their FIG. 6 position. Tuck-flap 22 is then folded inward. It is important to note that the upper end 63 of this tuck-flap does not penetrate an excessive distance under top flap 62 (see FIG. 1). Lastly, top flap 62 is folded and secured (i.e., glued) to only the overlapped portions of side flaps 60 and 61. Glue is not applied to portion 63 of tuck-flap 22. Thus, once zipper flaps 20 and 21 are removed, as aforesaid, end 10, including its flaps 60, 61 and 62, are separated from the box and the end can be removed and discarded.

Figure 3:
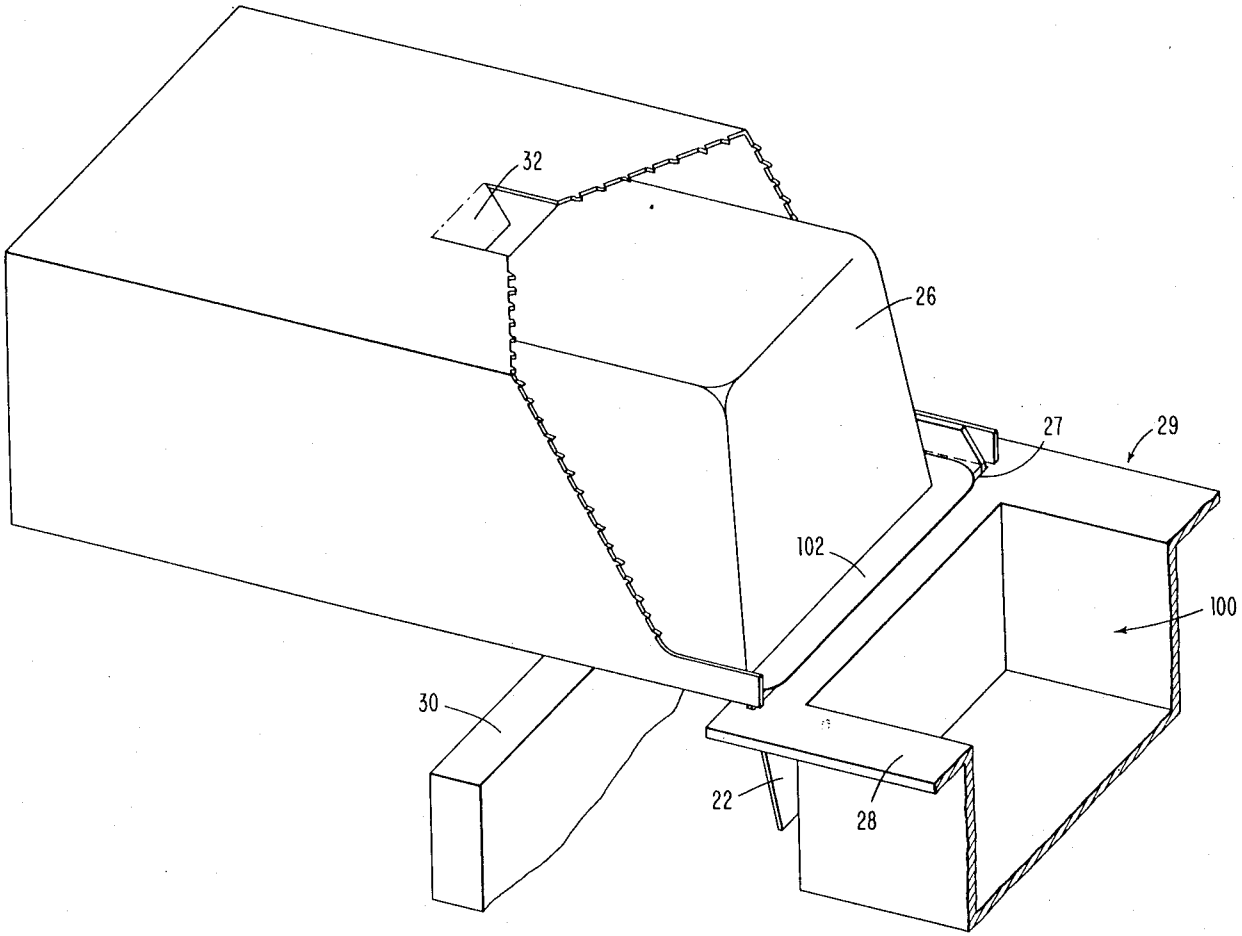
FIG. 3 is a view showing the end (10) of the outer package removed, to expose a full toner cartridge (26). The package's tuck-flap (22) has been inserted into a slot (27) in the flange (28) of the reproduction device's toner replenisher unit (29).

The unique utility of tuck-flap 22 is evident from FIG. 3. There it is shown that the reproduction device's toner replenisher 29 includes a toner compartment 100 which is adapted to hold somewhat more than the eight-pound capacity of cartridge 26. As is known to those of skill in the art, toner is metered from compartment 100 to the reproduction device's magnetic brush developer (not shown) as toner is gradually used up in the production of prints. The upward facing opening of compartment 100 is of a complementary shape to the bottom shaped opening of toner cartridge 26. This upward shaped opening includes a continuous flange 28 which surrounds the opening, and which includes means (not shown) for guiding, sealing and clamping the complementary flange 102 which is formed about the cartridge's bottom disposed toner dump opening. Flange 28 includes a slot 27 which is constructed and arranged to receive flap 22, with a somewhat close fit, so as to effectively provide a means for mounting the box onto the toner replenisher, as shown. In this position, the box is manually held in a horizontal position, as cartridge 26 is slid onto replenisher. In the case of a 3800-like construction, an exterior cabinet member 30 is conveniently available to aid in the horizontal positioning of the box, as shown in FIG. 3. Notch 31 which is formed in the top of cartridge 26 (FIG. 5) provides a convenient means on which to manually push, in order to move the cartridge from the box to the replenisher.

Now that the cartridge is in position on the replenisher, the box can be released from manual support, and the cartridge can be opened, to dump its content to compartment 100. The exposed end of the cartridge (i.e., the end which is not exposed to view in FIG. 3) contains the pull tab of a traveling fold seal strip which is peelably sealed to cartridge flange 102 (reference may be had to the aforesaid copending application for a detailed description of this seal strip). A further unique utility of the present invention is that the box remains in position, mounted to slot 27, during the opening of cartridge 26. As such the box is in position to receive the cartridge's seal, whatever may be its form, and to also receive any toner which may be transported out of the cartridge on the seal. Thus, clean loading of toner into the replenisher is insured.

Figure 2:
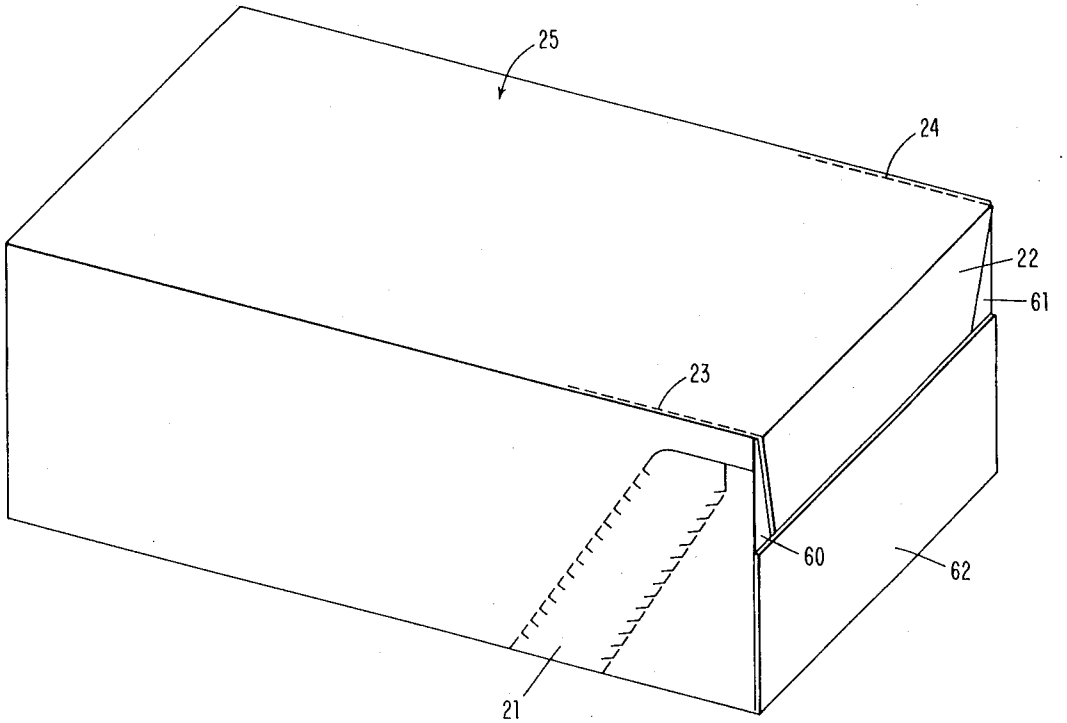
FIG. 2 is a view of the same end of the outer package, but shows the underside of the package, and the way in which the package's tuck-flap (22) is attached to the bottom surface (25) of the package by a pair of zipper perforations (23, 24)

As previously mentioned, the box hangs from slot 27 during the procedure of opening the toner cartridge. This hanging attitude is better facilitated by the provision of two zipper perforations 23 and 24 (FIG. 2) located on the bottom surface 25 of the box. Manual separation of these perforations allows the box to better hang relative developer flange 28; and in the case of the 3800-like construction, zipper perforations 23 and 24 provide a unique utility relative cabinet member 30, as seen in FIG. 4.

In some xerographic devices, the toner cartridge is left in position on the top of the replenisher, much in the nature of a cover. In others, the cartridge is immediately removed, after toner is dumped to the replenisher, and a separate cover is put in its place. In the case of the former type, the box is stored and later remounted to slot 27, as aforesaid, in order to receive the empty cartridge 26. The box is then removed, and discarded, as a box containing a full cartridge is immediately mounted on slot 27. In the case of the latter type device, the box is left in position to immediately receive the now-empty cartridge—again facilitating cleanliness of the entire operation.

FIG. 4 shows that a portion of the box associated with zipper perforations 23 and 24 sticks up above the plane of replenisher flange 28. Depending upon the type of clamp which is used to hold and seal cartridge flange 102 to replenisher flange 28 (and the details of this clamp are not critical to the present invention), it is possible, within the teachings of the present invention, to modify the location of zipper perforated tabs 20 and 21 in order to eliminate the aforesaid portions of the box. For example, with reference to FIG. 1, an alternative construction moves the zipper perforations on the sides of the box, such that tabs 20 and 21 terminate at the ends of zipper perforations 24 and 23, respectively. Reference number 200 has been added to FIG. 1 to identify the terminating end of tab 20 for such an alternate construction of the present invention. With this construction and arrangement, the removable portion 10 of the box now must be separated from the remainder of the box, after removal of tabs 20 and 21, by the additional step of separating the remaining portion of zipper perforations 23 and 24. In this case, however, no portions of the box remain above the plane of flange 28, when this alternate construction is in the position of FIG. 4.

While the invention has been particularly shown and described with reference to preferred embodiments thereof, it will be understood by those skilled in the art that various changes in form and details may be made therein without departing from the spirit and scope of the invention.

What is claimed is:

1. A method of replenishing xerographic toner to a xerographic reproduction device, comprising:

providing a toner cartridge which contains a supply of xerographic toner and is packaged in an overpack, one end of which is openable in a manner to expose said cartridge;

opening said one end, leaving a mounting-tab which facilitate mounting of said overpack on the reproduction device with said cartridge in position to be moved out of said one end of the overpack onto said replenisher;

mounting said overpack on said reproduction device by inserting said mounting-tab into a tab receiver which is adjacent the replenisher of said reproduction device; and moving said cartridge out of said overpack onto the replenisher of said reproduction device.

2. The method of claim 1 wherein said one end of said overpack is removable, to expose said cartridge, and wherein removal of said end leaves said mounting-tab attached to the remaining portion of said overpack which contains said cartridge.

3. The method of claim 2 including the step of unsealing said cartridge after said cartridge has been moved out of said overpack onto the replenisher of said reproduction device.

4. The method of claim 3 wherein said toner cartridge is bottom-dumping, and includes a manually operable traveling-fold seal, and wherein said overback includes zipper perforations which form an extension of said mounting-tab, such that after said cartridge has been moved onto said replenisher, the now-empty remaining portion of the overpack may be positioned with its empty cavity facing upward, to receive said traveling-fold seal, as the cartridge is unsealed.

5. The method of claim 4 wherein said overpack is disposable, and wherein said one end is removable by virtue of removable zipper-perforated tabs, said one end including a slit into which said mounting-tab is secured without the use of glue and the like.

6. A toner cartridge package system, for use with a xerographic reproduction device having a flap-receiving slot adapted to receive and support a package, comprising:

a closed parallelepiped shaped package having a top wall, a bottom wall, two end walls and two side walls, one end wall defining an end out of which the toner cartridge is adapted to be unloaded from the package into the reproduction device;

said one end wall being formed by two side wall flaps which are folded inward, and a top wall flap which is of a dimension to cover only the top portion of said side wall flaps, said top wall flap being folded and fastened to the overlapped portions of said side wall flaps in a manner to leave at least the center portion of said top wall flap unfastened, and a bottom wall flap which is folded and tucked under at least said center portion of said top wall flap, to thereby close said end of the package; and zipper perforated removable tab means encircling a portion of the top wall and side walls of the container adjacent said one end, and terminating at said one end, such that removal of said tab means facilitates removal of a portion of said top wall including said top wall flap, and a portion of said side walls including said side wall flaps, leaving said bottom wall flap intact for use in mounting the package on a reproduction device.

7. The package system of claim 6 wherein said zipper perforated tab means comprises two separate tabs which meet on the top wall of said package, and individually terminate at the lower edge of opposite side walls adjacent said end, the point of meeting on the top wall of the package including a through-cut enabling easy removal of said tabs.

8. The package system of claim 7 including zipper perforations formed along the lower edges of said side walls, adjacent said one end, to enable the effective length of said bottom wall flap to be extended after removal of said portion of said top and side walls.

9. The package system of claim 8 wherein said two tabs individually terminate at through-cuts adjacent the lower edges of said side walls.

10. The package system of claim 9 wherein said two tabs individually terminate at said zipper perforations formed along the lower edge of said side walls.

* * * * *